US006148806A

United States Patent [19]

Mueller

[11] Patent Number: 6,148,806

[45] Date of Patent: Nov. 21, 2000

[54] VALVE UNIT

[75] Inventor: Heinz Mueller, Remseck, Germany

[73] Assignee: Filterwerk Mann & Hummel GmbH, Ludwigsburg, Germany

[21] Appl. No.: 09/297,673

[22] PCT Filed: Nov. 4, 1997

[86] PCT No.: PCT/EP97/06091

§ 371 Date: Jul. 2, 1999

§ 102(e) Date: Jul. 2, 1999

[87] PCT Pub. No.: WO98/20236

PCT Pub. Date: May 14, 1998

[30] Foreign Application Priority Data

Nov. 6, 1996 [DE] Germany ..... 196 45 665

[51] Int. Cl.[7] ..... F02M 13/02

[52] U.S. Cl. ..... 123/572

[58] Field of Search ..... 123/572, 573, 123/574, 41.86

[56] References Cited

U.S. PATENT DOCUMENTS 4,169,432 10/1979 White ..... 123/41.86

5,080,082 1/1992 Mueller et al. ..... 123/572

*Primary Examiner*—Marguerite McMahon

*Attorney, Agent, or Firm*—Evenson, McKeown, Edwards & Lenahan, P.L.L.C.

[57] ABSTRACT

Disclosed is a subunit for a machine driven by an internal combustion engine, in which the components are integrated in a module and wherein means have been provided to connect the module to the internal combustion engine.

5 Claims, 6 Drawing Sheets

VALVE UNIT

Figure 1A:
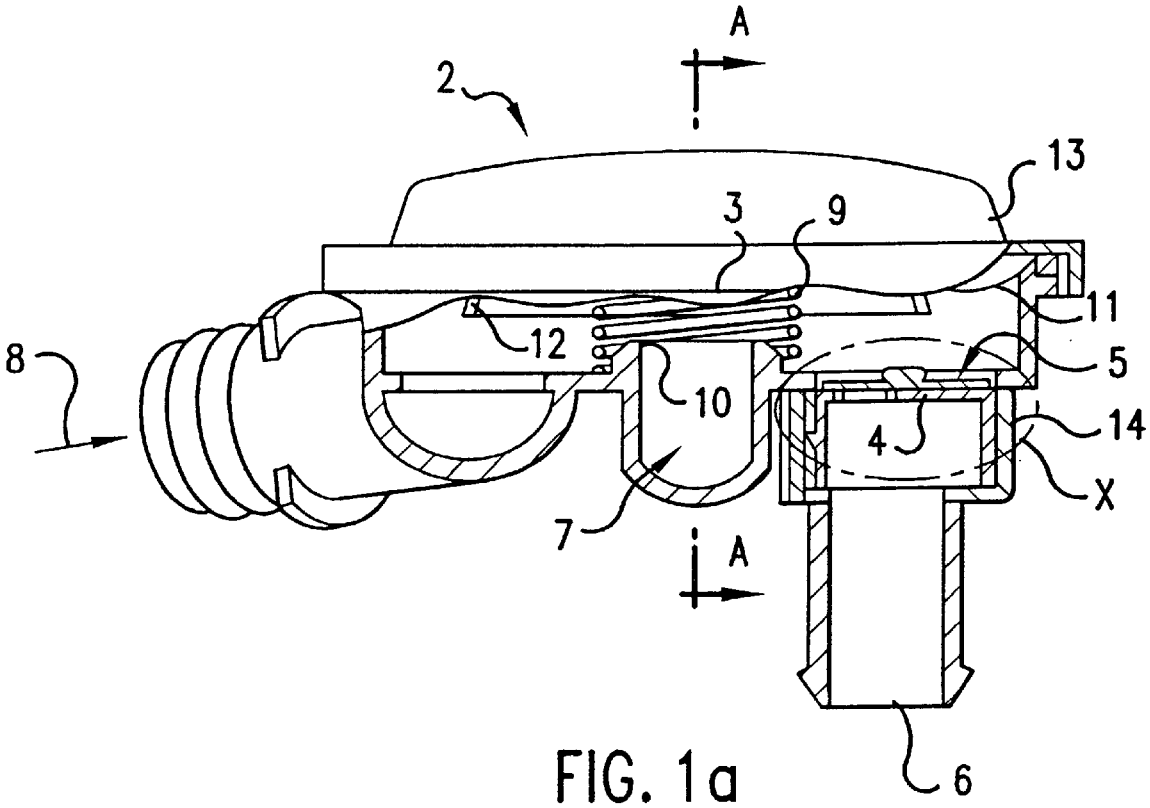

The invention relates to a subunit for a machine driven by an internal combustion engine according to the preamble of claim 1.

Such subunits are described, for example, in German Petty Patent 1,883,625. A valve system is described for connecting the air intake duct or the vacuum zone of a carburetor to the crankcase of an internal combustion engine wherein gases which are forced past the piston of the engine into the crankcase are returned to the engine cylinders and consumed together with the combustible mixture produced by the carburetor.

Furthermore, a valve unit of this kind is disclosed in U.S. Pat. No. 3,139,080 which describes means for the elimination of crankcase gases, since these crankcase gases are considered a source of atmospheric pollution.

If it is desired to use such subunits in modern motor vehicles or other equipment driven by internal combustion engines, it is disadvantageous that the known subunits have corresponding outside dimensions and a correspondingly great weight.

The size of the component could be reduced, which would result in a weight reduction. It is, however, disadvantageous that the space required by the various individual units and their connecting lines is great and so is their weight.

The invention is thus addressed to the problem of improving a subunit of the kind described above so as to result in a subunit which will be easier to install, lighter, cheaper and more compact.

This problem is solved according to the invention in that components are put together in a module and that means are provided whereby the module can be connected to the internal combustion engine. It is advantageous that both the manufacturing costs of the individual functional units and the costs of final assembly plus weight can be reduced. Due to its structural integration, synergies between the different functional units are achieved, which contribute to the said cost saving. The provision of modules for the final assembly also simplifies the logistics. The modular construction of the subunit also has a favorable effect on the recycling of the subunits. The combining of the functional units in one module furthermore permits rapid reaction to changing marketing plans.

An advantageous embodiment of the invention provides for the integration in the module of a support body which can be connected to the internal combustion engine and to which the components of the module are fastened. This support body gives the module a structure which on the one hand defines how the module is to be connected to the internal combustion engine and how the individual components of the module are to be arranged. One possibility would be, for example, to use the air filter case as a support body.

Another advantageous embodiment of the invention provides for the module to contain as a component a crankcase pressure control valve and an idling vacuum valve which are combined in a single functional unit resulting in savings both in weight and in cost.

In an advantageous embodiment of the invention, the device communicates with the crankcase and/or the filter chamber, especially on the clean-air side of the latter. This assures that the crankcase gases responsible for emissions remain in the overall system of the internal combustion engine and are delivered to the combustion process.

An advantageous embodiment of the invention provides that the module can be expanded with additional components. For example, it would be conceivable to bring together all essential valve subunits which are connected with the operation of an internal combustion engine.

An embodiment of the invention provides that the module comprise as an additional component an oil filler tube and/or an oil dip stick and/or an AKF valve as described in German Patent 42 05 101 in claims 2–5 as well as in the description, col. 1, line 51 to col. 2, line 13, and/or a throttle valve and/or the device for operating same. The advantage lies in the combining of functional groups which are in a working relationship, since in this manner the paths of communication, the housing dimensions, and the total weight of the subunit are reduced.

In another advantageous embodiment of the invention, the crankcase pressure control valve acts as a support for the module, by means of which the module can be connected to the internal combustion engine. Its advantage as a structural body of the module lies in its size and in its manner of operation, which anyway makes direct contact with the housing of the internal combustion engine to appear advantageous, based also on the fact that it gets a certain strength from the housing.

In an advantageous embodiment of the invention at least one component of the module consists of a plastic. Even the complete construction of the module and its components from plastic is also conceivable. Construction of the module in plastic leads positively to cost savings and weight reductions and eventually to a low fuel consumption in the operation of the internal combustion engine.

In another advantageous embodiment of the invention, the crankcase pressure control valve and/or the idling vacuum valve are arranged to be connected to the induction tube and the crankcase. This arrangement assures that the crankcase gases will remain in the circuit of the internal combustion engine of the vehicle.

An advantageous embodiment of the invention provides for the module to be integrated in, on or at the cylinder head or its cover, resulting in short communication paths and small housing dimensions, since a portion of the cylinder head or its cover can be used also as a module housing. It would also be conceivable to provide the module in or on the air filter case, since here too functional advantages are to be found.

These and other features of preferred embodiments of the invention will be found not only in the claims but also in the description and the drawings, it being possible for the individual features to be realized individually or together in the form of sub-combinations in the embodiment of the invention and in other fields, and can be advantageous as well as independently patentable embodiments for which protection is hereby claimed. Embodiments of the invention are represented in the drawing and are explained below.

Figure 1B:
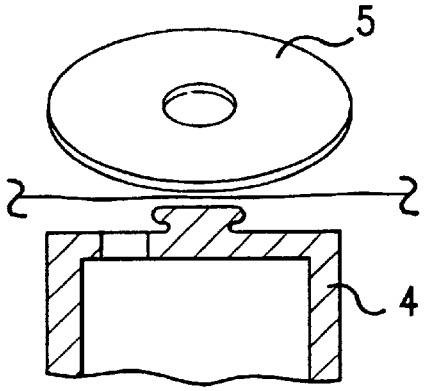

In the drawings,

FIG. 1*a* shows a section through a module,

FIG. 1*b* detail x from FIG. 1*a,*

Figure 2:
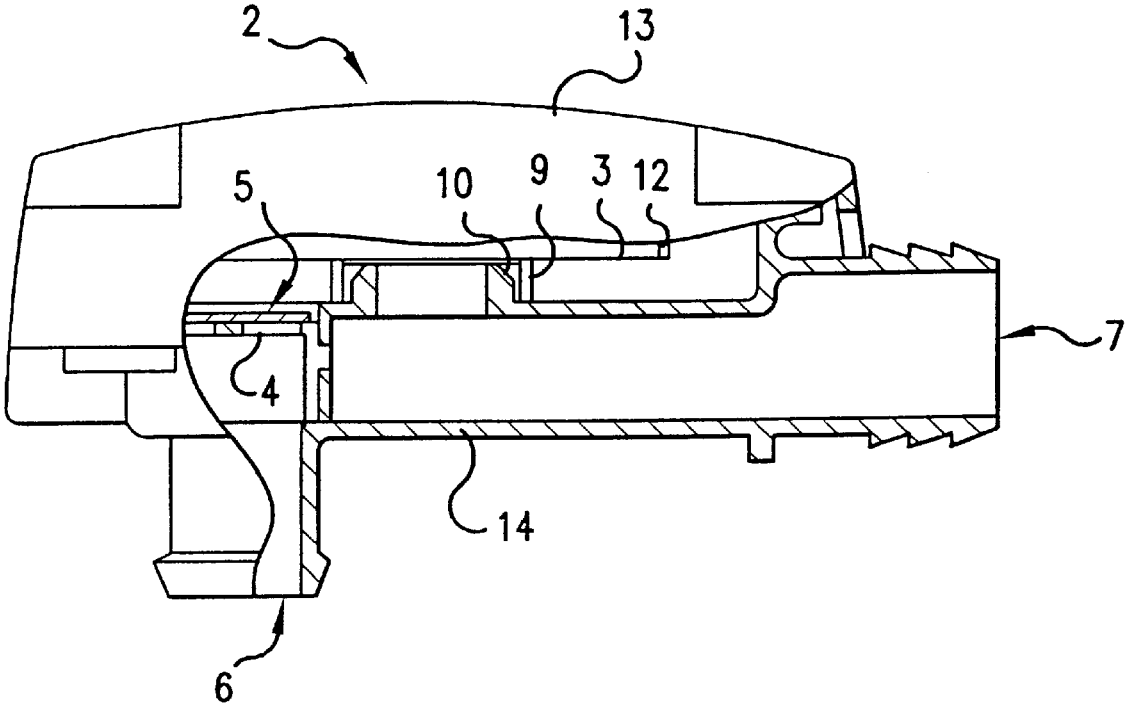
Figure 3:
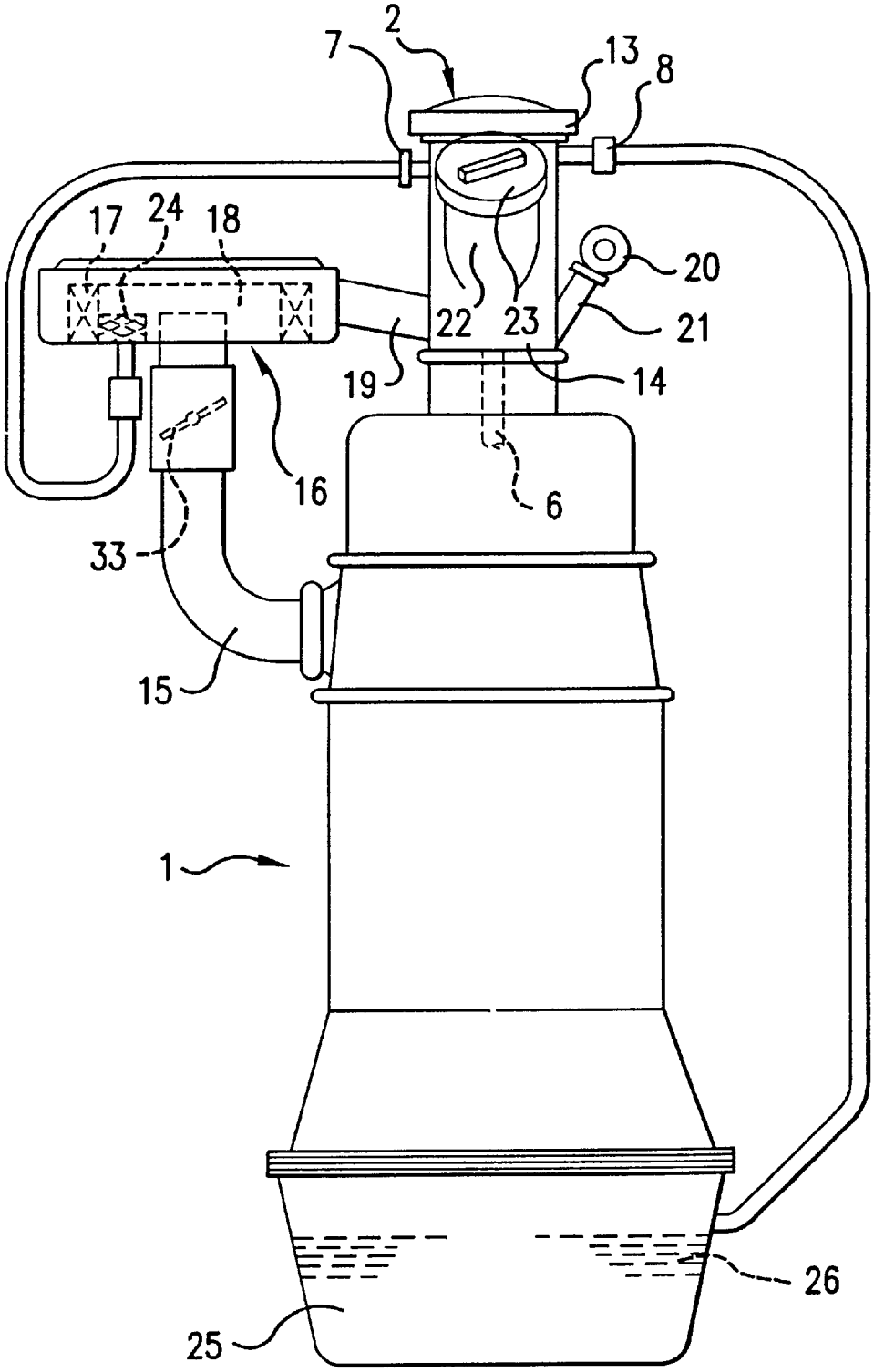
Figure 4:
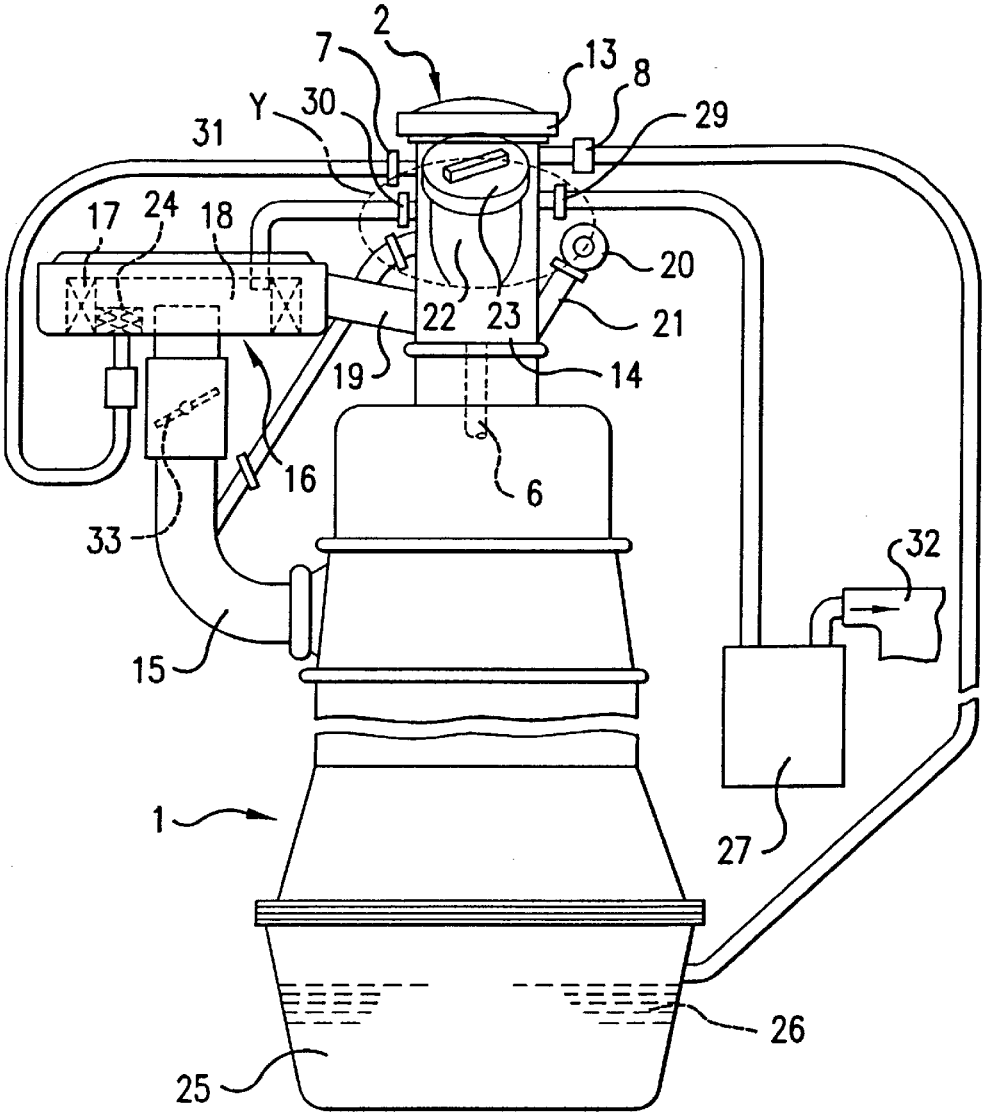
Figure 5:
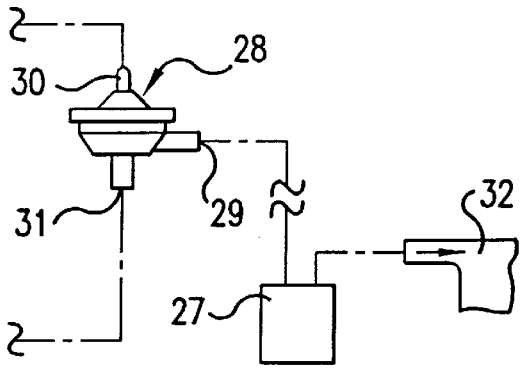
Figure 6:
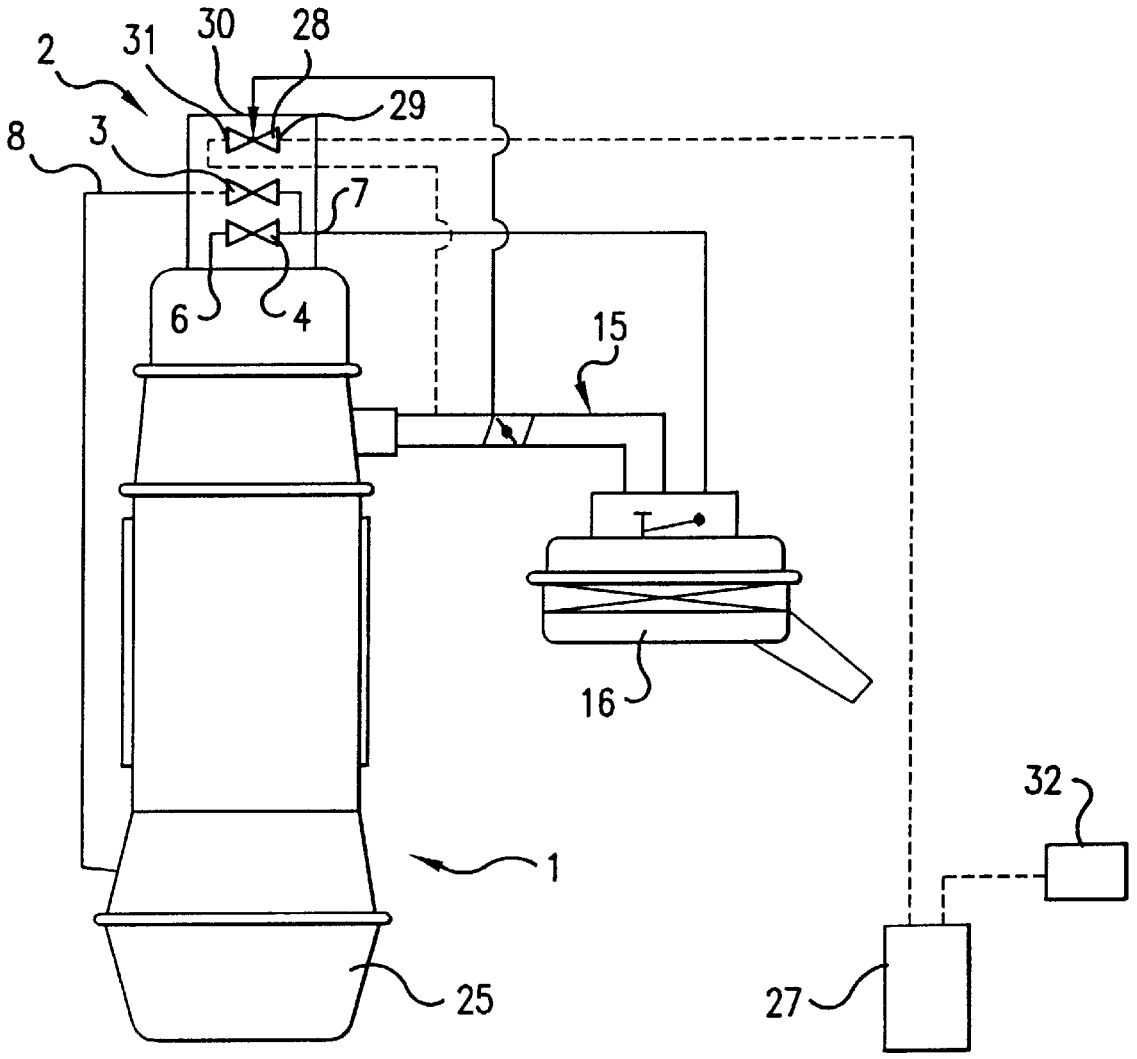
Figure 7:
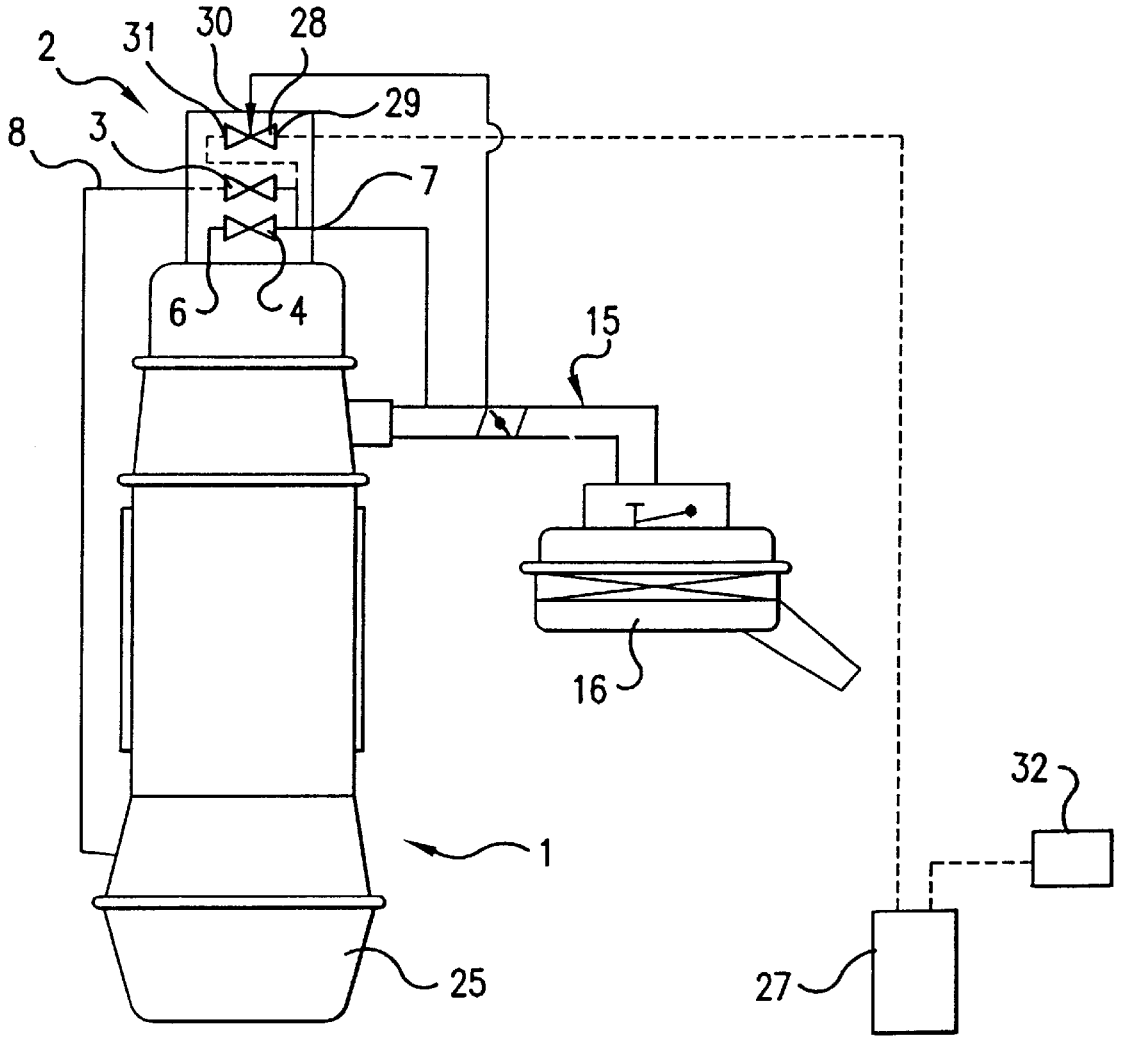

FIG. 2 a section through the module of FIG. 1 along line AA,

FIG. 3 a compact module on a schematically represented internal combustion engine, FIG. 4 a more compact module on a schematically represented internal combustion engine, FIG. 5 detail Y of FIG. 4, FIG. 6 a schematic representation of the module on the internal combustion engine, FIG. 7 a schematic representation of the module on the internal combustion engine.

The module 2, which is represented in FIG. 1*a,* contains a crankcase pressure control valve 3, which is housed together with an idling vacuum valve 4 in the module housing 14. The crankcase pressure control valve diaphragm 11 controls the flow of crankcase gases, which pass into the module either through the crankcase inlet to the cylinder head 6 or to the crankcase gas inlet on the oil pan 8, to the crankcase gas outlet 7, the crankcase pressure control diaphragm 11 being supported by the crankcase pressure control valve spring 9 and the crankcase pressure control valve seat 10 and the crankcase pressure control valve plate 12. The module housing is shielded from the atmosphere by module cover 13.

Detail X of FIG. 1*a* is shown enlarged in FIG. 1*b*. It shows the idling vacuum valve 4 integrated into the module 2 along with the corresponding diaphragm 5 which reduces the cross section to the extent that the blow-by gas is aspirated by the vacuum that is produced. It is in this manner that the detection of vacuum in the crankcase is achieved.

In FIG. 2, the module 2, which is already shown in FIG. 1*a,* is represented along the line AA. It has a crankcase pressure control valve 3 which is housed together with an idling vacuum valve 4 in the module housing 14. The crankcase pressure control valve diaphragm 11, which here is concealed by the module cover 13, regulates the feeding of crankcase gases to the crankcase gas outlet 7, the gases passing into the module 2 either through the crankcase gas inlet on the cylinder head 6 or the crankcase gas inlet on the oil pan 8 which is likewise invisible in this section, while the unseen crankcase pressure control valve diaphragm 11 is supported by the crankcase pressure control valve spring 9 and the crankcase pressure control valve seat 10 and the crankcase pressure control valve plate 12.

The internal combustion engine 1, which is represented schematically in FIG. 4, has on its upper end on the cylinder head cover a module 2 which contains a crankcase pressure control valve and an idling vacuum valve, of which only the crankcase gas inlet on the cylinder head 6, the crankcase gas outlet 7 and the crankcase gas inlet on the oil pan 8 are visible.

The elements shown in FIGS. 1 and 2, such as the crankcase pressure control valve spring, crankcase pressure control valve seat, crankcase pressure control valve diaphragm and crankcase pressure control valve plate are concealed in FIG. 3 by the module cover 13 and the module housing 14. The induction tube 15 which contains the air filter case 16 which contains a filter insert 17 which separates the clean air side 18 from the raw air side 19, connects as communicating tubes to the motor of the vehicle, and has a throttle valve 33 for controlling the flow of the combustion gas.

The module represented in FIG. 3 already has a very high integration density than the one in FIGS. 1 and 2, since in addition the oil dip stick 20 with dip stick holder 21 are contained in module 2. The feeding of the crankcase gases is performed in the area of the air filter case 16 on the clean air side, i.e., in the direction of flow after the filter insert 17. The introduction of the crankcase gases is performed for safety reasons and to produce vacuum in the crankcase, since they are combustible in the area of a flame guard 24 disposed in the air filter case 16. As it can be seen in this example, a portion of the crankcase gases is collected in the area of the oil pan 25, just above the oil well 26.

The internal combustion engine 1, which is represented schematically in FIG. 4, has at its upper end, like the machine shown in FIG. 3, or on the cylinder head cover, a module 2 which contains a crankcase pressure control valve and an idling vacuum valve, of which only the crankcase gas inlet on the cylinder head 6, the crankcase gas outlet 7, and the crankcase gas inlet 8 from the oil pan 8 are visible. Additionally, the embodiment shown has an AKF valve of which only the elements listed herewith are visible: The AKF valve inlet 29 which communicates with the active carbon canister 27 which in turn is connected to the tank 32 of the motor vehicle, as well as AKF valve control connection 30 and AKF valve outlet 31.

The unseen AKF valve 28, which is indicated in FIG. 4 as detail Y, is shown enlarged in FIG. 5 where the AKT valve inlet 29 can be seen which communicates through the active carbon canister 27 with the tank 32 of the vehicle. In FIG. 5 the AKF valve inlet 29 and AKF valve outlet 31 are likewise seen.

The elements shown in FIGS. 1 and 2, such as the crankcase pressure control valve spring, crankcase pressure control valve seat, crankcase pressure control valve diaphragm and crankcase pressure control valve plate are hidden in FIG. 3 by the module cover 13 and the module housing 14, the same as AKF valve 28. The induction tube 15, which contains the air filter case 16 comprising a filter insert 17 separating the clean air side 18 from the raw air side 19, connects as communicating tubes with the motor of the vehicle, has a throttle valve to control the rate of flow of the combustible gas. [Translator's note: The italicized clause appears to be out of context in the German.]

The module 2 represented in FIG. 4 has a still greater integration density than the one appearing in FIGS. 1, 2 and 3, since it additionally contains the AKF valve in module 2. The crankcase gases are introduced into the range of a flame guard 24 disposed in the air filter case 16 for safety reasons, since they too are combustible. As it is evident in this example, a portion of the crankcase gases is removed from a point in the oil pan, just above the oil level 26.

The internal combustion engine 1 is shown schematically along with the module 2 in FIG. 6. The crankcase pressure control valve 3 in module 2 receives the crankcase gases through the crankcase gas inlet on the oil pan 25 just above the oil level, and it can be seen that the distance covered by this line is comparatively long, which has the advantage that this feeding of crankcase gas, especially when idling, is not so greatly affected by the pulsation. Also contained in module 2 is the idling vacuum valve 4 which gets its crankcase gases directly from the crankcase gas inlet on the cylinder head 6, so that here very short paths of communication can be achieved if the module 2 is mounted near the cylinder head. Both the crankcase pressure control valve and the idling vacuum valve are served by the common crankcase gas outlet 7, which either communicates with the air filter case 16, as represented in FIG. 6, or, in an alternative embodiment, communicates directly with the air induction tube 15. In the module 2 an AKF valve 28 is also integrated. This AKF valve 28 communicates via the AKF valve inlet 29 with the active carbon canister 27, which in turn is connected to the fuel tank 32 of the motor vehicle. The AKF valve control is in communication with the pressure conditions existing in the air induction tube 15 in the manner previously described in German application 42 05 101, so that fuel vapors formed in the conditions described are fed into the induction tube 15 through the AKF valve outlet 31.

In FIG. 7 the internal combustion engine 1 and module 2 are represented schematically. The crankcase pressure control valve 3 contained in module 2 receives the crankcase gases through the crankcase gas inlet on the oil pan 8. Also contained in module 2 is the idling vacuum valve 4 which receives its crankcase gases directly from the crankcase gas inlet on the cylinder head 6, so that very short communication paths can also be realized here if the module 2 is mounted near the cylinder head. Both the crankcase pressure control valve and the idling vacuum valve are fed from the common crankcase gas outlet 7, which either communicates with the air filter case 16, as represented in FIG. 6, or in an alternative embodiment communicates directly with the air induction tube 15. An AKF valve 28 is also integrated into module 2. This AKF valve 28 communicates by way of the AKF valve inlet 29 with the active carbon canister 27 which in turn communicates with the fuel tank 32 of the motor vehicle. The AKF valve connection 30 communicates with the pressure conditions existing in the induction tube 15 in the manner already described in DE 42 05 101, so that in the previously described states of operation fuel vapors are fed into the induction tube 15 through the AKF valve outlet 31 which in this embodiment is placed together with the crankcase gas outlet.

In an alternative embodiment the valve seats both of the crankcase pressure control valve are heatable. This is done by means of an electrically powered heater resistance which is mounted so that the seat surfaces are warmed in case of frost, so that failure of the valve to function in winter becomes impossible. The heater resistance is supplied by the on-board electrical system of the vehicle. If the ambient temperature drops to levels around or below zero degrees, a thermostat gives a signal to the on-board control in which a control signal is generated which activates the heater resistance in the valve seat, so that such valves remain functional at temperatures around or below zero. In a special embodiment the heatable seat of such a valve consists, for example, of sheet copper.

What is claimed is:

1. A subunit for a machine driven by an internal combustion engine, said subunit comprising:

a crankcase pressure valve and an idling vacuum valve, the crankcase pressure valve being connected to and communicating with a crankcase through a crankcase gas outlet, and through a crankcase gas inlet from an oil pan, wherein said crankcase gas outlet communicates with an air induction tube or with a clean air side of a filter chamber;

wherein the crankcase pressure valve and the idling vacuum valve are integrated in a module housing which is mounted as a module on the internal combustion engine such that a direct connection of the idling vacuum valve to an additional crankcase gas inlet from the cylinder head is formed, and wherein the feeding of crankcase gases from the crankcase gas inlets from the cylinder head and from the oil pan to the crankcase gas outlet is regulated by the crankcase pressure control valve.

2. The subunit according to claim 1, wherein the module further comprises at least one of an oil filler opening and an oil dipstick and an AKF valve and a throttle valve and a throttle valve actuating device.

3. The subunit according to claim 1, wherein the crankcase pressure valve is a support for the module whereby the module can be connected to the internal combustion engine.

4. The subunit according to claim 1, wherein at least one component of the module is plastic.

5. The subunit according to claim 1, wherein the module is integrated in or on the cylinder head or a cover of the cylinder head.

* * * * *